United States Patent [19]

Baermann

[11] 3,999,705

[45] Dec. 28, 1976

[54] MAGNETIC RETURN DEVICE FOR RESET TIMER/COUNTER UNIT AND RESET TIMER/COUNTER UNIT USING SAME

[75] Inventor: Max Baermann, Bensberg, Germany

[73] Assignee: Gulf & Western Industries, Inc., New York, N.Y.

[22] Filed: Oct. 28, 1975

[21] Appl. No.: 625,835

Related U.S. Application Data

[62] Division of Ser. No. 511,051, Oct. 1, 1974.

[52] U.S. Cl. ..... 235/144 ME; 235/91 M; 235/104; 235/132 R

[51] Int. Cl.[2] ..... G06C 15/42

[58] Field of Search ... 235/144 ME, 144 E, 144 EM, 235/144 R, 104, 132 R, 132 A, 132 E; 58/125 C; 335/219, 238

[56] References Cited

UNITED STATES PATENTS

| | | | |
|---|---|---|---|
| 3,112,069 | 11/1963 | Truespell | 235/144 ME |
| 3,311,299 | 3/1967 | Stautmeister | 235/144 ME |
| 3,584,202 | 6/1971 | Kline | 235/133 R |
| 3,885,136 | 5/1975 | Erickson | 235/144 ME |

FOREIGN PATENTS OR APPLICATIONS

| | | | |
|---|---|---|---|
| 1,160,775 | 3/1958 | France | 235/144 ME |

*Primary Examiner*—L.T. Hix
*Assistant Examiner*—Vit W. Miska
*Attorney, Agent, or Firm*—Meyer, Tilberry & Body

[57] ABSTRACT

A device adapted for special use in a reset timer/counter unit to return various digital counting subwheels to their reset condition after a timing or counting cycle. The device includes a first ring formed from a permanently magnetizable material having a generally circular first pole surface with a set of opposite polarity magnetic poles arranged in a selected pole pattern on the first pole surface and means for securing the first ring onto one of the subwheels or other device to be returned to a selected position. The second ring formed from a permanently magnetizable material is provided with a generally circular second pole surface generally facing the first pole surface and having opposite polarity magnetic poles arranged in a pole pattern matching the selected pattern of the first surface with poles of the first surface generally facing opposite polarity poles of the second surface when the members to be controlled are in a selected angular returned, or known, position.

6 Claims, 35 Drawing Figures

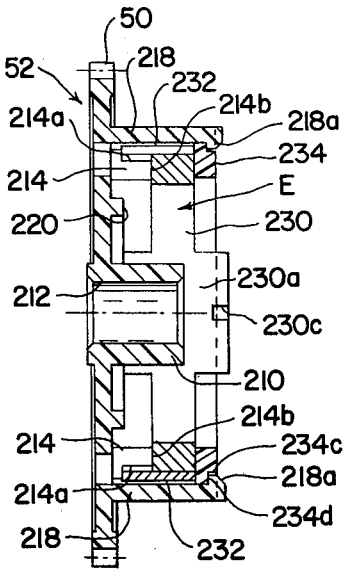
FIG. 7B
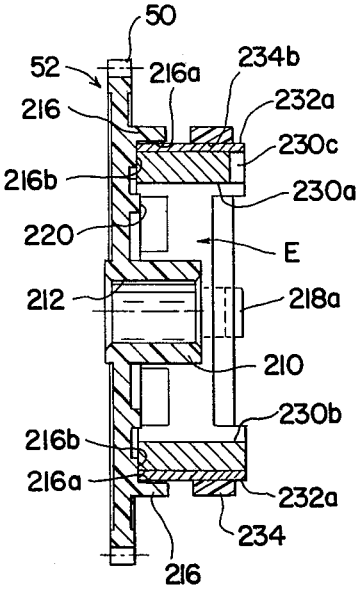
FIG. 7C
FIG. 8
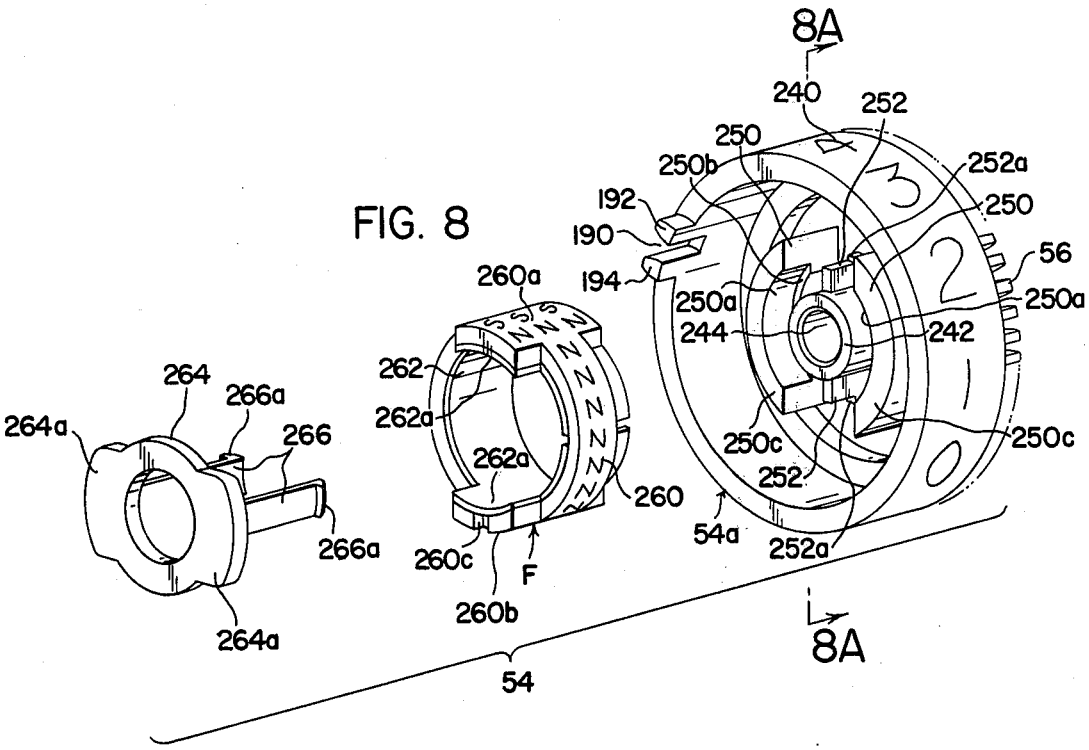

MAGNETIC RETURN DEVICE FOR RESET TIMER/COUNTER UNIT AND RESET TIMER/COUNTER UNIT USING SAME

This is a division of application Ser. No. 511,051 filed Oct. 1, 1974.

The present invention relates to the art of timer/-counter units and more particularly to a magnetic return device for a reset timer/counter unit and the reset timer/counter unit using the same.

The invention is particularly applicable for use as a timer having a somewhat digital display and it will be described with particular reference thereto; however, it is appreciated that the invention has broader applications and may be used as either a timer or a counter according to the type of drive arrangement being used in the unit. The magnetic return unit itself has broader applications and may be used in various other environments wherein one member is to be returned to a selected position with respect to another member after being displaced therefrom.

BACKGROUND OF INVENTION

It has become common practice to employ reset timers for controlling industrial machinery and processes. These reset timers generally include a face plate having a window which indicates the digits of the timing cycle. These digits may be manually changed by repeatedly depressing buttons adjacent each exhibited digit. After the timing cycle has been set, the timer repeatedly times the cycle corresponding to the setting appearing at the face plate of the unit. Generally, the visually displayed digits are the numbers on the periphery of axially spaced resettable wheel assemblies. During the counting cycle, digits appearing at the face of the timer count down in generally decimal fashion until reaching all zeros. At this time, the cycle is completed and can be repeated. This type of reset timer has one obvious disadvantage. The timing cycle is not known as the cycle is being timed because the wheel assemblies are counting down during the cycle. In addition, the cycle length for the next cycle can not be changed during a timing cycle of the unit. In order to change the timing cycle, a manual override reset button is often provided. This terminates existing timing cycle and allows the new cycle to be set. In many instances, the termination of a cycle may not be desirable even though a new cycle is desired.

In addition, the reset wheel assemblies used in prior reset timers have often included two relatively movable subwheels one of which is locked in place during the setting and the other of which is movable during the counting and carries the display digits for the counting cycle. There is provided between these two subwheels a cam arrangement which attempts to bring the number carrying subwheel back to a set position after a cycle has been timed and the driving mechanism of the timer is disengaged. This cam return or cam reset mechanism often included a heart-shaped cam wherein the indentation of the heart was the reset position. By this arrangement, a biased follower in one of the subwheels engaged the heart-shaped cam and attempted to bring the two subwheels into a given angular alignment by the action of the cam and the spring biased follower. Excessive wear of the cam and follower mechanism often occurred. This reduced the intended life of the timer. Also, after the follower had moved along the cam for a prolonged time, certain dead spots were sometimes created wherein the numbered wheels would not reset to the proper position by the camming action between the two subwheels. These disadvantages of prior marketed reset timers or counters was overcome by an improved timer/counter unit, which used a magnetic system for returning the number carrying subwheels back to the set or reset position after each timing cycle.

In the prior magnetic return timer or counter there was provided a first bank of manually adjustable number wheels journalled coaxially about a first shaft and arranged from least significant to most significant digits and a second bank of resettable wheel assemblies journalled coaxially about a second shaft generally parallel to the first shaft with one of the wheel assemblies adjacent to and corresponding to one of the number wheels. Each of the number wheels had a gear generally concentric with the first shaft and numerical indicia circumferentially spaced around the first shaft. Separate manual means were provided for indexing the number wheels about the first shaft to selected positions corresponding to a desired counting cycle and means for holding the number wheels in the selected positions. Each of the resettable wheel assemblies included first and second subwheels mounted to rotate about the second shaft. The first subwheel had a gear meshing with the gear of its corresponding number wheel whereby the angular position of the first subwheel about the second axis was determined by the angular position of the gear of its corresponding number wheel. The second subwheel of each wheel assembly included a drive gear coaxial with the second shaft and magnetic biasing or returning means for rotating the second subwheel to a selected position with respect to the first subwheel when the second wheel was released and free to rotate about the second axis whereby the second subwheel of each of the resettable wheel assemblies could return to the position set by its corresponding number wheel. The magnetic biasing or return means includes a first set of permanent magnets carried by the first subwheel and a second set of permanent magnets carried by the second subwheel. These permanent magnets were mutually balanced when the second subwheel was in its selected position with respect to the first subwheel. This provided a magnetic resetting of the driven subwheels to the previously set digital condition of the first subwheel.

The first set of magnets in the first subwheel in the return system of this prior unit were cylindrical, axially magnetized bar-like magnets arranged substantially diametrical with respect to the first subwheel and with radially, outwardly facing, opposite polarity magnetic poles. The second set of magnets were similar to the first set and mounted in the second subwheel so that they would ride in an axially spaced plane with respect to the first set of bar-like magnets. In the balanced condition, the axially spaced sets of permanent bar-like magnets were in magnetic balance with the poles of the magnets facing in different, axially spaced planes. This provided a magnetic return arrangement wherein the magnetic fields surrounding the cylindrical magnets of each set would produce the magnetic balancing forces. This type of magnetic system, for returning one subwheel back to its reset position with respect to the corresponding subwheel, provided a substantial improvement in the art of reset timer/counter unit.

THE INVENTION

The present invention relates to an improved magnetic returning system for use in a reset timer/counter unit or other types of devices wherein one member is rotatably mounted with respect to the other member and is to be returned to a set selected position when released and free to rotate. This improved device provides a more positive returning position and avoids any tendency to have a non-positive return to a precise location.

In accordance with the present invention, there is provided a device for returning a first member, rotatable about a given axis, to a selected angular position with respect to a second member. The improvement in this device is a first ring formed from a permanently magnetizable material, which first ring has a generally circular first pole surface with opposite polarity magnetic poles arranged in a selected pole pattern on the first pole surface. This first ring is secured to one of the first and second members with the first pole surface generally concentric to the axis. A second ring formed from a permanently magnetizable material is also provided. The second ring has a generally circular second pole surface generally facing the first pole surface and having opposite polarity magnetic poles arranged in a pole pattern matching the selected pattern, with the poles of the first surface generally facing opposite polarity poles of the second surface when the first member is in the selected angular position. Also, the second ring is secured onto the other of the first and second members with the second surface generally concentric to the axis.

In accordance with the invention, each of the pole surfaces include two opposite polarity magnetic poles extending circumferentially around the pole surface. In the returned position, the circumferentially extending poles of one ring face opposite polarity poles of the other ring. In accordance with another aspect of the invention, the opposite polarity poles of each pole surface extend substantially 180° so that one semi-circular portion of a pole surface has one magnetic polarity and the other semi-circular portion of the same surface has the opposite magnetic polarity. In accordance with still a further aspect of the invention, at the junction between the two opposite polarity magnetic poles, the pole surfaces have a greater width than the pole width of the remaining portion of the poles which extend around the circumference of the pole surfaces. With this greater width at the junction between the two poles of each of the two rings, a strong positive returning action is provided to precisely rotate one ring with respect to the other ring in the magnetically returned position.

In accordance with another aspect of the invention, at least one of the two magnetic rings is movable axially in a first direction by the attractive force between the two rings in the returned position. This attraction induced movement of one of the rings with respect to the other ring allows the use of a friction braking means which is engageable upon this relative movement. The friction braking means causes friction damping when the rings are rotated into their returned position by the magnetic system of the present invention.

The primary object of the present invention is the provision of a device for returning a first member rotatable about its axis to a selected position with respect to the first member, which device includes an improved magnetic return system having a positive returning action.

Another object of the present invention is the provision of a reset timer/counter unit employing the improved magnetic return system as defined above.

Another object of the present invention is the provision of a magnetic return system which employs two concentric permanent magnet rings each having a circumferential pole surface, with the pole surfaces facing each other.

Another object of the present invention is the provision of a return magnetic system as defined above wherein the rings include magnetic poles extending around the circumferences of the pole surfaces with opposite polarity poles facing each other at the returned position.

Another object of the present invention is the provision of a return system as defined above which system includes a friction damping arrangement responsive to the magnetic system seeking its attracted balanced condition.

BRIEF DESCRIPTION OF DRAWINGS

These and other objects and advantages will become apparent from the following description taken together with the accompanying drawings in which:

FIG. 7 is an end view taken generally along line 7A–7A of FIG. 7;

FIG. 8 is an exploded view of the number subwheel and the magnetic system thereof;

GENERAL DESCRIPTION OF A TIMER EMPLOYING THE PRESENT INVENTION

Figure 1:
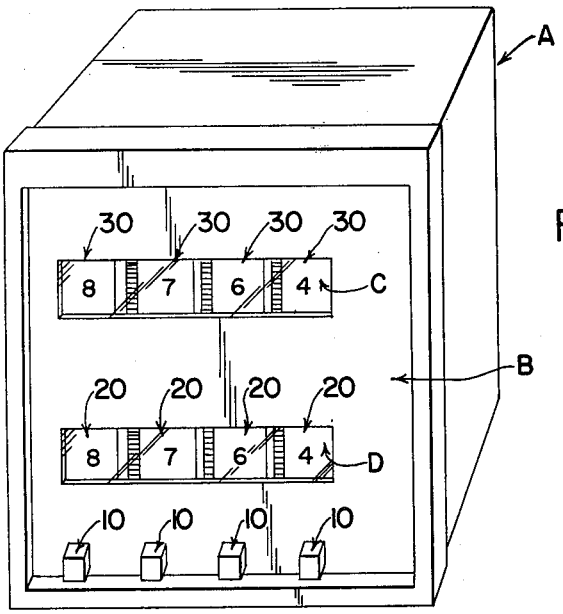
FIG. 1 is a pictorial view illustrating a preferred embodiment of the present invention.

Referring now to the drawings wherein the showings are for the purpose of illustrating the preferred embodiment of the invention only and not for the purpose of limiting same, the general type of timer to which the present invention relates and its general operation will be disclosed before a specific disclosure of the preferred embodiment.

FIG. 1 shows a timer/counter unit A having a face plate B, upper window C and a lower window D. Push buttons 10 manually change the position of the individual wheels 20 within a bank of number wheels viewed through window D. Above the bank of number wheels and meshed therewith in a manner to be described later, is a second bank of axially aligned wheels illustrated as resettable wheel assemblies 30 viewed through window C. In operation, cycle of unit A is set by successively depressing push buttons 10 to index by a single digit the various numbers appearing in window D and on the periphery of number wheels 20. After the proper cycle has been set in the window D, the unit is ready to time a cycle corresponding to that number. The range of the cycle is determined by internal gearing of unit A. Before the cycle starts, the unit is reset which shifts the resettable wheel assemblies 30 to the numbers appearing in window D. This reset number is shown in window C of FIG. 1. After this resetting of wheel assemblies 30, the cycle can be timed by decrementing the number in window C until the digitals all reach zero. At this time, a switch is actuated as will be explained later to indicate the end of the counting cycle. Thereafter, the unit can be reset. This resets the resettable wheel assemblies 30 to the position corresponding with the numbers in the lower number wheels 20 as shown in window D. It is appreciated that these numbers or digits in window D can be changed by the push buttons 10 while the counting or timing cycle using wheel assemblies 30 is taking place without affecting the cycle being counted or timed. In accordance with the unit so far described, the setting of the next cycle appears in the window D and the remaining time or counts of the cycle in process appears in window C. This provides complete information to an observer regarding the condition of the unit even during the counting or timing cycle.

Figure 2:
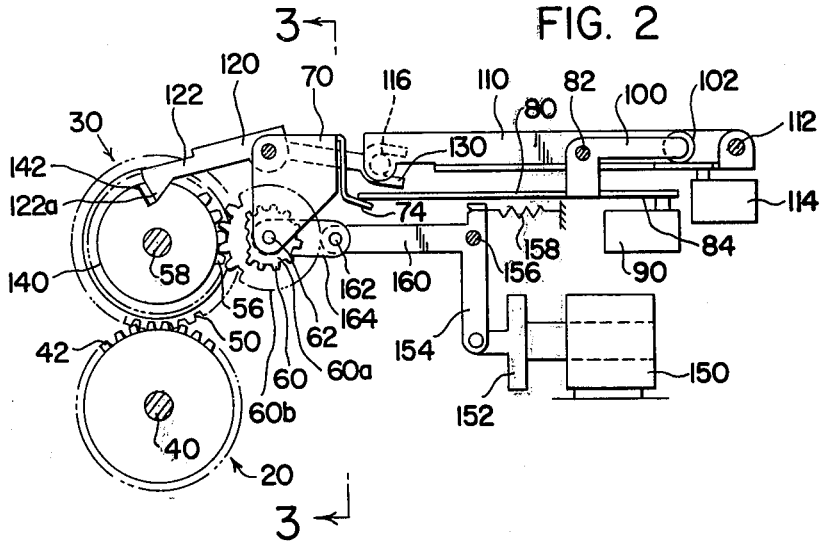
FIG. 2 is a partial, schematic side elevational view illustrating the external controls and the reset mechanism.
Figure 3A:
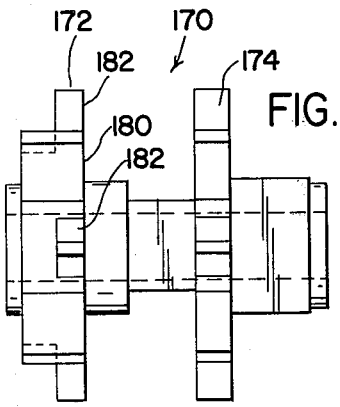
FIG. 3A is an enlarged view taken generally along line 3A—3A of FIG. 3.
Figure 3B:
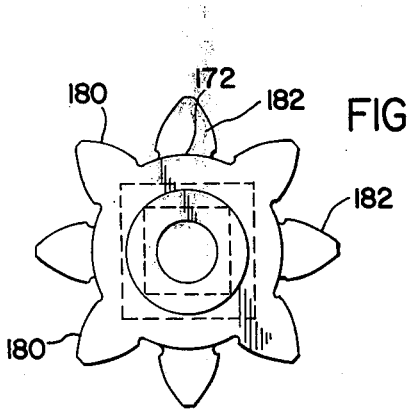
FIG. 3B is a view taken generally along line 3B—3B of FIG. 3A.
Figure 3:
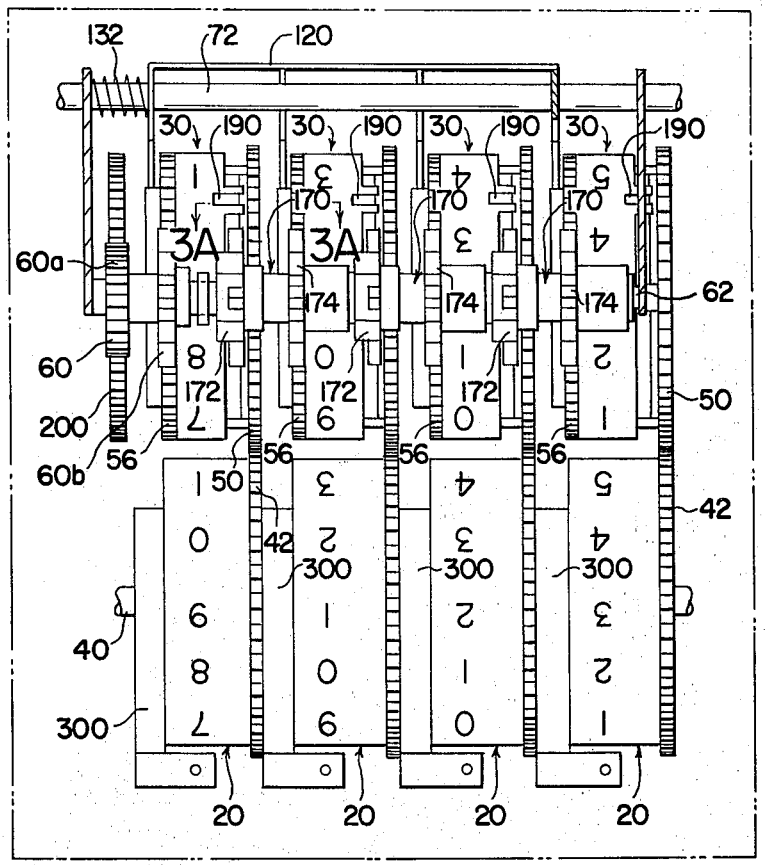
FIG. 3 is a plan view taken generally along line 3—3 of FIG. 2.
Figure 4:
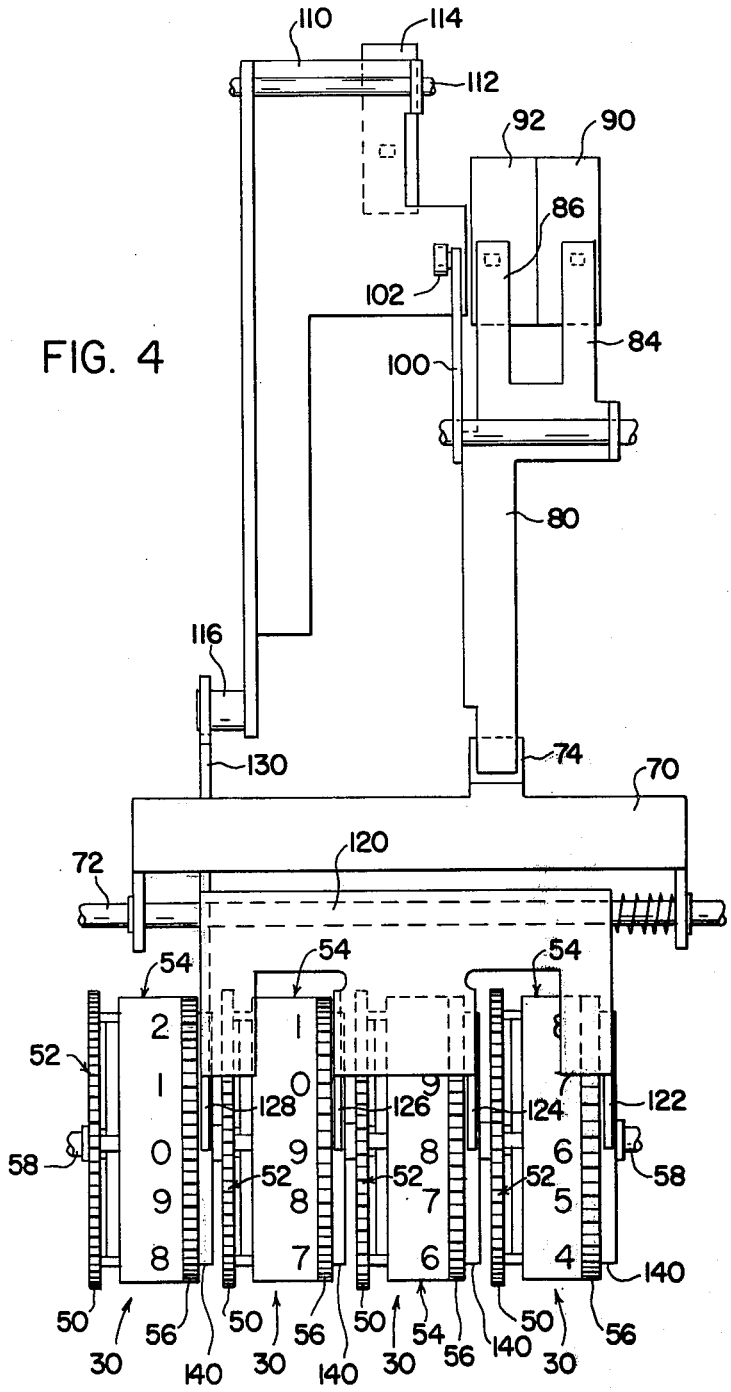
FIG. 4 is an enlarged top elevational view showing the reset mechanism and switch actuating mechanism of the preferred embodiment.

Referring now more particularly to FIGS. 2, 3 and 4, the bottom bank of number wheels 20 is journalled on shaft 40. Each of the number wheels includes a ring gear 42 meshed with a similar ring gear 50 on a corresponding upper resettable wheel assembly 30 located directly above the corresponding number wheel. The resettable wheel assemblies 30 each include a first settable subwheel 52 and a coaxially mounted second number subwheel 54, the details of which will be explained later. When the subwheel 54 is released it will return to a set position with respect to the first subwheel 52 to reset the resettable wheel assembly 30 to the number appearing in window D of FIG. 1. This second subwheel 54 includes an outer drive gear 56, and both subwheels 52, 54 are journalled to rotate about shaft 58, which is generally parallel and above shaft 40 of number wheels 20.

During the counting or timing cycle, a pinion drive gear 60 is rotatably mounted above a shaft 62, generally parallel with shaft 58. Gear 60 includes two sections 60*a*, 60*b* with section 60 being meshed with the drive gear 56 of the least significant digit in the upper bank of wheel assemblies 30. In FIG. 1, the wheel assembly which is engaged by section 60*b* of pinion 60 is the right hand wheel assembly 30 viewed through window C. In a timing mode, pinion 60 is rotated at an angular speed to determine the range of the timing cycle. During the timing cycle, the gear 52 holds gear 50 of the first subwheel 52 in each wheel assembly 30 so that the various first subwheels do not rotate and their position is fixed by the position of the lower number wheels 20.

As best shown in FIG. 3, after the least significant second subwheel assembly 54 is rotated a single rotation, the next most significant subwheel 54 is advanced by a single digit. This process is continued from one subwheel 54 to the next so that the subwheels 54 which carry the digits shown in window C of FIG. 1 count down to zero in a normal digit counting process. A variety of interconnecting and transfer arrangements could be used; however, in the preferred embodiment the interconnecting arrangement includes a plurality of gears journalled on shaft 62, as shown in FIG. 3. These gears will be explained later in more detail.

Shaft 62 and the gears carried thereon, including pinion 60, are supported on an axially extending bracket 70 having an upper fixed pivot shaft 72 and a rearwardly extending tab 74. This tab engages the under surface of a reset switch plate 80 which is pivoted about a shaft 82. The rearward portion of the switch plate includes switch actuators 84, 86 for depressing switches 90, 92 when the unit is reset. The switches can start a new cycle after reset. Plate 80 also includes a transfer reset arm 100 including an eccentric 102 which is rotated to adjust the interconnection between the switch plate 80 and an adjacent cycle actuated switch arm 110. Switch arm 110 is journalled about rear shaft 112 and controls a lower switch 114. Of course, various switches could be used and their actuation could be sequential to provide sequential controls of the external circuits and the reset cycle of the timer. The forward end of cycle actuated arm 110 includes a transversely extending stub shaft 116 which is used to control the movement of a zero count bracket 120 during the reset cycle and for controlling the movement of switch arm 110 by zero count bracket 120 at the completion of a counting or timing cycle. A further discussion of this operation will follow.

Figures 5, 5A, 5B:
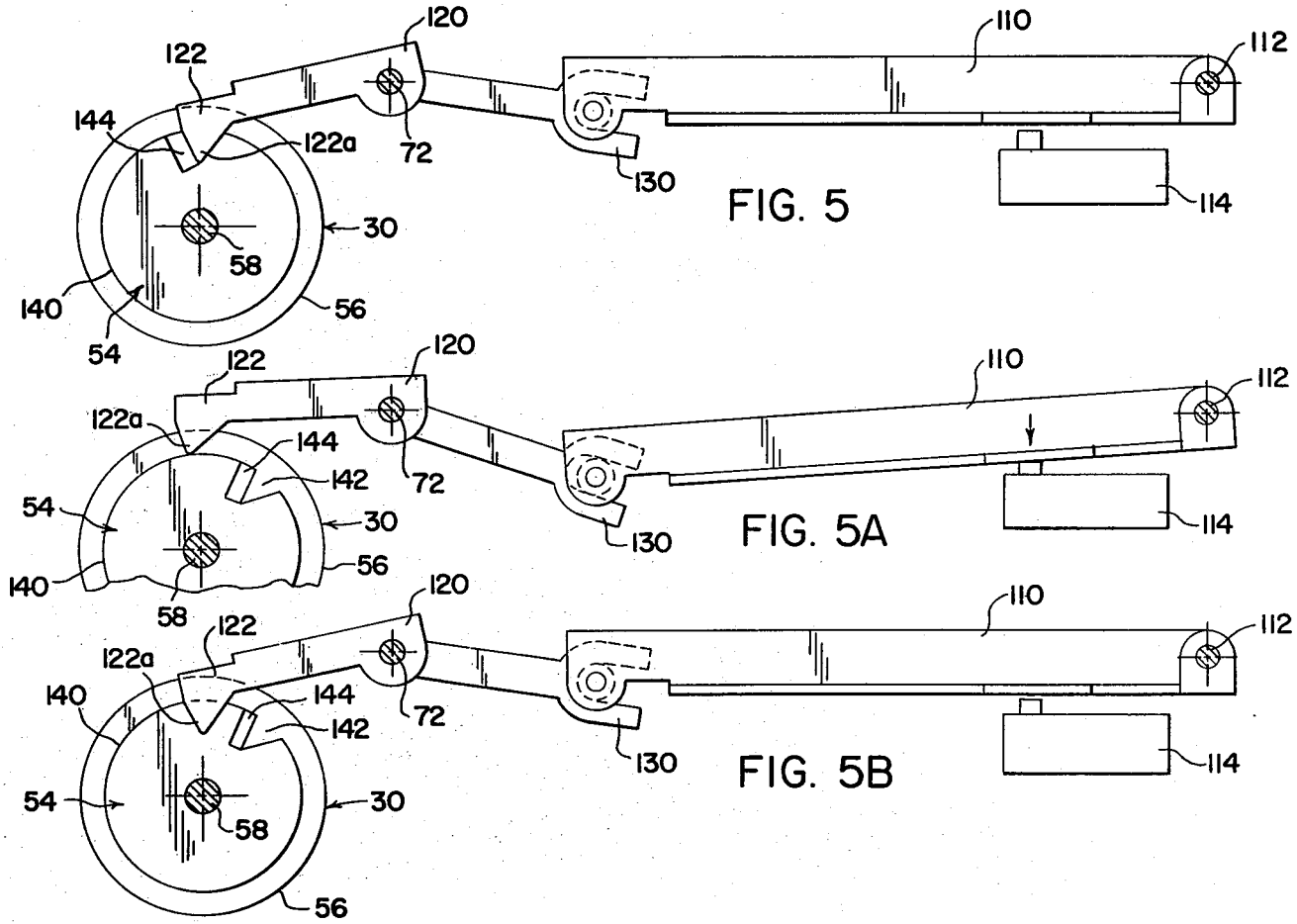
FIG. 5 is a schematic view illustrating the operation of the switch actuating mechanism when a cycle has been completed.
FIG. 5A is a view similar to FIG. 5 showing the same mechanism during the counting cycle.
FIG. 5B is a view similar to FIG. 5 showing the same mechanism when the preferred embodiment is counted beyond the set cycle.

The zero count bracket 120 best shown in FIGS. 4 and 5 includes axially spaced fingers 122, 124, 126 and 128 and is journalled on fixed shaft 72. The fingers each include downwardly extending pointed protrusions 122*a*, 124*a*, 126*a* and 128*a*, respectively. Extending in the opposite direction from fingers 122–128 is bifurcated arm 130 adapted to surround the stub shaft 116. As shown in FIG. 4, the zero count bracket 120 can be shifted to the right against the action of a spring 132 surrounding shaft 72. Each of the fingers 122–128 is aligned with a cam surface 140 on the second subwheel 54 of each resettable wheel assembly 30. This cam surface includes a zero recess 142 which is aligned with one of the fingers 122–128 when the corresponding subwheel 54 is in its zero position to show a zero in window C of FIG. 1. The forward portion of recess 142 includes a cam incline 144. In operation, as best shown in FIGS. 5, 5A and 5B, all of the subwheel assemblies 54 are oriented to present zeros in window C, the recesses 142 are aligned with fingers 122–128. This allows the protrusions 122*a*–128*a* to drop, in unison, into recesses 142. This can happen only when all zeros appear in the window C. If one of the subwheels 54 is not at a displayed digit zero, the cam surface 140 of that wheel holds the zero count bracket in its upper position. FIG. 5 shows the zero count position where the subwheels 54 have counted down to zero. When this happens, the fingers drop and bifurcated arm 130 is pivoted upwardly to raise cycle actuated switch arm 110 about its rearward pivot shaft 112. This releases switch 114.

The position of bracket 120 during the counting cycle is illustrated in FIG. 5A. In this condition, at least one of the protrusions 122*a*–128*a* engage its cam surface 140 and holds the arm 110 in its downward position by the bifurcated arm 130. Arm 110 is moved upwardly when the zero condition is reached, as shown in FIG. 5. Referring now to FIG. 5B, the condition illustrated therein occurs when the unit is driven after the zero count has been reached and bracket 120 has shifted into the position shown in FIG. 5. When this happens, the cam incline 144 on each of the second subwheels 54 cams the protrusions 122*a*–*128a* from the recess 142. This shifts the zero count bracket 120 to the right, as shown in FIG. 4, against the action of spring 132. By providing this camming action, the motor can continue to operate after a counting or timing cycle has been completed and recorded by switch 114. Thus, it is not essential that the motor or the drive means be stopped exactly at the zero count in the preferred embodiment of unit A.

Referring again to FIG. 2, a solenoid 150 having a standard armature 152 controls a bellcrank 154 for driving and resetting the resettable wheel assemblies 30. The bell-crank includes a fixed pivot shaft 156, return spring 158 and a control arm 160. The control arm is connected by a pivot pin 162 to control the movement of an arm 164 journalled on shaft 62. The structure in FIG. 2 is shown in the counting mode with the solenoid 150 released to force gear 160, and all other gears on the shaft 62, into engagement with the second subwheels of the resettable wheel assemblies 30. It is noted that the arms 160, 164 form a toggle action to increase the force required to disengage pinion 60, and the other gases on shaft 62, from the wheel assemblies during the driving operation. Shaft 62, pin 162 and shaft 156 are generally in alignment in the driving mode. After the driving operation has been completed, the fingers on zero count bracket 120 drop into the recesses 142 of the rotated subwheels 54. This is also shown in FIG. 2. At that time, the unit A is ready for a reset operation. The reset is accomplished by actuating solenoid 150. This forces arm 160 in a downward arc and pulls arm 164 downwardly. Shaft 62 is then moved away from shaft 58 as bracket 70 pivots about shaft 72. This disengages the pinion from the least significant subwheel 54 and also releases all other interconnecting gears carried by shaft 62 from the subwheels 54. When bracket 70 pivots in a counterclockwise direction for reset, tab 74 lifts reset switch plate 80, which pivots around shaft 82. This depresses cycle actuated switch arm 110 by the action of the eccentric 102. The downward movement of switch arm 110 forces the bifurcated arm 130 downwardly and lifts the fingers 122–128 from the subwheels 54. If the fingers have been shifted due to an overcount, the lifting action causes the fingers to be raised and the bracket 120 is shifted to the left, as shown in FIG. 4, by spring 132. Thus, by the action of solenoid 150, the subwheels 54 are completely released from driving gears or from the fingers on the arm 120. Thus, they are free to rotate and return to the position determined by the adjusted position of first subwheels 52 of each resettable wheel assembly 30. The mechanism for this returning action will be described later as another aspect of the present invention. After a reset operation, the window C again displays the same digits as the window D. Solenoid 150 is then released and the drive gears and the wheel interconnecting gears on shaft 62 are forced into driving relationship with the upper resettable wheel assemblies 30 to repeat the counting or timing cycle.

Figure 6:
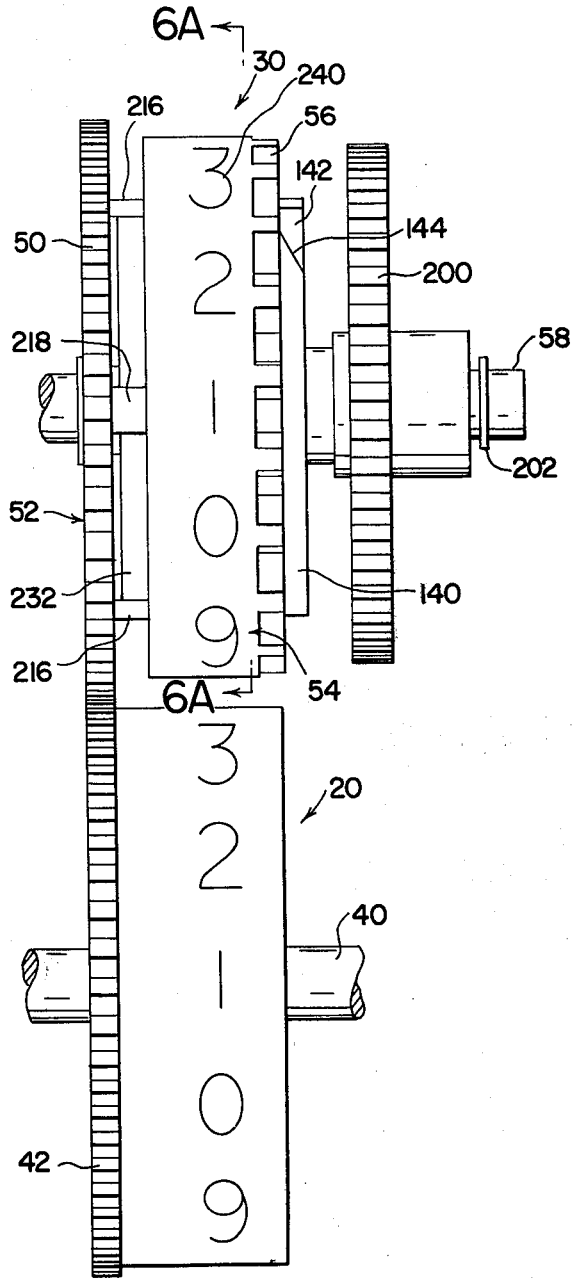
FIG. 6 is an enlarged view showing the interconnection between a number wheel and a resettable wheel assembly.
Figure 9:
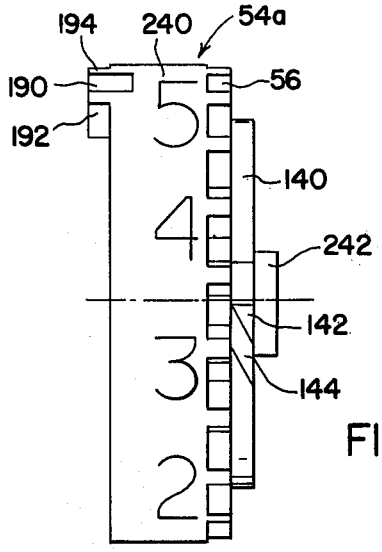
FIG. 9 is a view taken generally along line 9–9 of FIG. 8A.

As previously mentioned, a variety of arrangements could be used for driving the adjacent subwheels during the counting or timing cycle. In accordance with the illustrated embodiment shown in FIGS. 3, 3A and 3B, the adjacent wheels are connected by a double gear assembly 170 including a gear 172 coacting with the lesser significant digit subwheel 54 and a gear 174 engaging the gear 56 of the more significant subwheel 54. When the gear 172 is rotated, this rotates the next subwheel assembly 54. In accordance with one practice, gear 172 has alternate teeth 180 extending axially across the gear and alternate gears 182 extending only part way across the gears. As best shown in FIGS. 6 and 9, each of the second subwheels 54 include a single gear receiving recess 190 on its periphery. This is the only place on the periphery of subwheel 54 which will accept one of the full teeth 180. Recess 190 is bounded by teeth segments 192, 194 which engage the partial teeth 182. During normal operation, the full teeth 180 ride on the outer surface of wheel 54. This prevents the rotation of the gear 172 and gear assembly 170 and locks the next subwheel 54 by the interaction of gear 174 and gear 56 of the next subwheel. After a single rotation of a lesser significant subwheel 54, gear segment 194 engages one of the smaller gears 182 starting rotation of gear assembly 170. This rotation can continue with the next large gear 180 extending into recess 190. Gear segment 192 then engages another small gear to withdraw the large gear from recess 190 and locate the full gears on the outer surface to lock assembly 170 in its indexed position until the next revolution of subwheel 54. In this manner, each revolution of a subwheel 54 indexes the next subwheel by an angle corresponding to one digit. This rollover feature continues until all subwheels are in the zero condition which then actuates the cycle actuated switch arm 110. During the reset operation solenoid 150 is energized which withdraws the various gear assemblies 170 from engagement with the subwheels 54. This allows each of the subwheels to turn to a position corresponding to the digit designation shown in window D of FIG. 1.

DESCRIPTION OF THE PREFERRED EMBODIMENT OF THE INVENTION

As previously mentioned, each wheel assembly 30 includes a settable subwheel 52 having its position set by the manually changeable wheel 20 and a number subwheel 54 which, when released, returns to an angular position established by the set position of subwheel 52. In accordance with the invention, the subwheels include a magnetic return system employing specially constructed magnets to provide the return action of subwheel 54 with respect to subwheel 52. The preferred embodiment is best shown in FIGS. 6, 6A, 6B, 7, 7A, 7B, 7C, 8, 8A, 8B and 8C. Referring now more particularly to the settable subwheel 52, best shown in FIGS. 7, 7A, 7B and 7C, this subwheel includes a main support element 52*a* which is an integrally mounted plastic member including a hub 210 for rotatably mounting the subwheel 52 on shaft 58 by an inner journal surface 212. Element 52*a* could take a variety of structural features for securing a permanently magnetizable ring E in adjusted angular positions concentric with the axis of shaft 58. In accordance with the preferred embodiment of the invention, element 52*a* includes four circumferentially spaced internal magnetic support ribs 214 each including an outer cylindrical surface 214*a* matching the inner surface of a flux concentrator ring and support element for the magnetic ring E, which flux concentrator ring will be described later. Ribs 214 also include upper magnet support platforms 214*b*. Surface 214*a* engages the cylindrical flux concentrator and platform 214*b* provides an axial support for a reduced portion of magnet ring E. Two external support ribs includes an inner cylindrical surface 216*a* matching the outer surface of the flux concentrator for ring E and a support platform 216*b* for receiving an enlarged portion of the permanent magnet ring E. Support surfaces 214*b* and 216*b* could be modified in various ways. For instance, surfaces 214*b* provide the axial support and surfaces 216*b* provide clearance for the enlarged portions of magnet E. Integrally formed on element 52*a* is a pair of diametrically spaced resilient locking fingers 218 having upper locking lips 218*a* for a purpose to be described later in assembling magnet E onto element 52*a*. A circumferentially extending braking rib or ring 220 is provided on element 52*a* and has an axially facing, circumferentially extending braking surface to dampen oscillating of subwheel 54 when it returns to its reset position. The braking action of rib 220 will be described in detail. This rib may be provided with a modified surface to increase the coefficient of friction between this rib and an element on number subwheel 54. This ring can be provided with a roughened surface by sand blasting the portion of the mold corresponding to the outer surface of ring 220.

Element 52*a* supports permanent magnet ring E. This ring is injection molded from permanently magnetizable particles, such as barium ferrite or Alnico, bonded in a binder of plastic material, such as Nylon. The process for making this type of magnet is know in the permanent magnet field. In accordance with the invention, magnet E is in the form of a ring having an inner pole surface 230 with two opposite polarity poles each of which extend approximately 180° around the circumference of pole surface 230. These poles are shown schematically in FIGS. 6A and 7. Permanent magnet ring E is magnetized radially; therefore, two magnetic poles having polarities opposite to the polarities of the two poles on surface 230 appear at the outer, cylindrical surface of magnet ring E. Of course, the two circumferentially continuous poles do not actually abut each other. There is a slight space at he junction of the two opposite polarity poles. These pole junctions are located at portions 230*a*, 230*b* of pole surface 230. These junction areas or portions have an enlarged pole width in a direction axially of pole cylindrical surface 230. Of course, the opposite polarity poles extending around pole surface 230 could be a series of closely spaced north poles in one semicircular portion and closely spaced south poles in the other semi-circular portion. Notch 230*c* is provided to indicate the polarity and proper orientation of ring E for assembly onto element 52*a*.

Surrounding the outer surface of magnet ring E is the previously mentioned flux concentrator ring, shown as cylindrical ring 232. Ring 232 provides a certain amount of support structure for magnet ring E. The split flux concentrator ring 232 is formed from a high permeability material in accordance with standard permanent magnet design principles and includes two diametrically spaced enlarged portions 232*a* which correspond and cover the outer portions of the enlarged pole surface areas 230*a*, 230*b*. This structure is clearly shown in FIG. 7. The flux concentrator ring 232 reduces the reluctance at the rear surface of magnet ring E to enhance the strength of the fields created at the poles facing radially inward from surface 230.

The third element of subwheel 52, in accordance with the preferred embodiment of the invention, is a lock ring 234 including diametrically spaced recesses 234*a* which fit over the enlarged portions 230*a*, 230*b* of magnet ring E and the corresponding portions 232*a* of the flux concentrator ring 232. Recesses 234*a* are clearance recesses to allow ring 234 to slip over the permanent magnet assembly, shown in the center portion of FIG. 7. Ring 234 also includes an inner cylindrical surface 234*b* which matches the outer surface of flux concentrator ring 232 in the assembled position, Diametrically opposed recesses 234*c* have lips 234*d* to coact with lips 218*a* for assembly of ring 234 onto element 52*a*.

Figure 7:
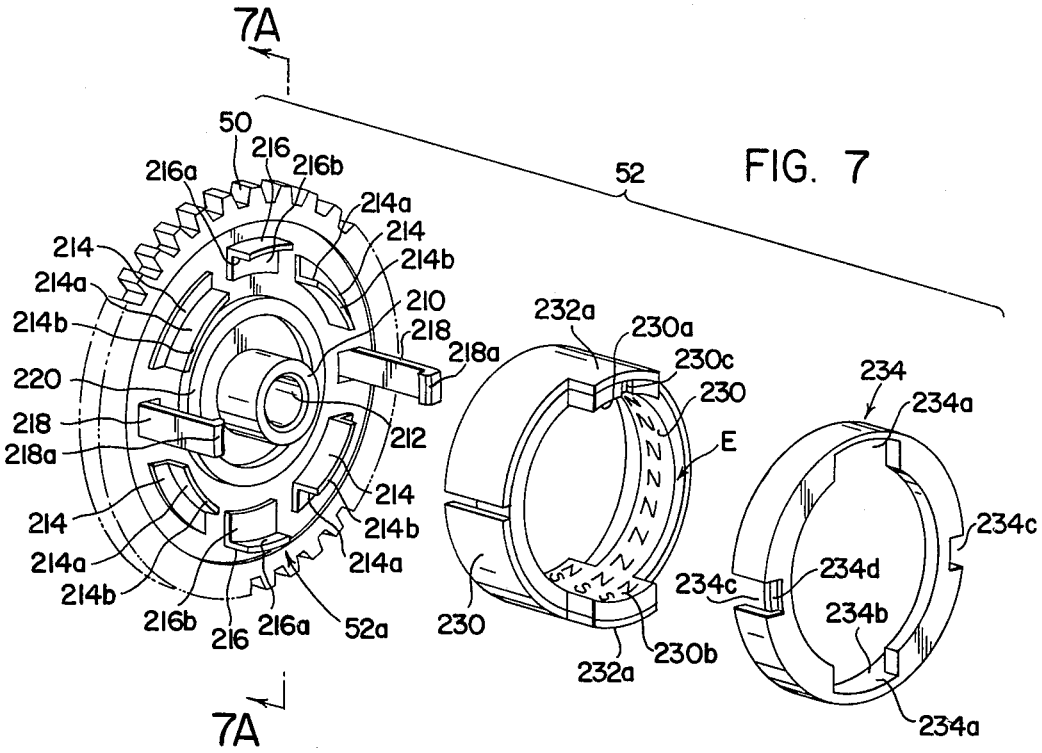
FIG. 7 is an exploded view of the resettable subwheel and the magnetic system thereof.
Figure 7A:
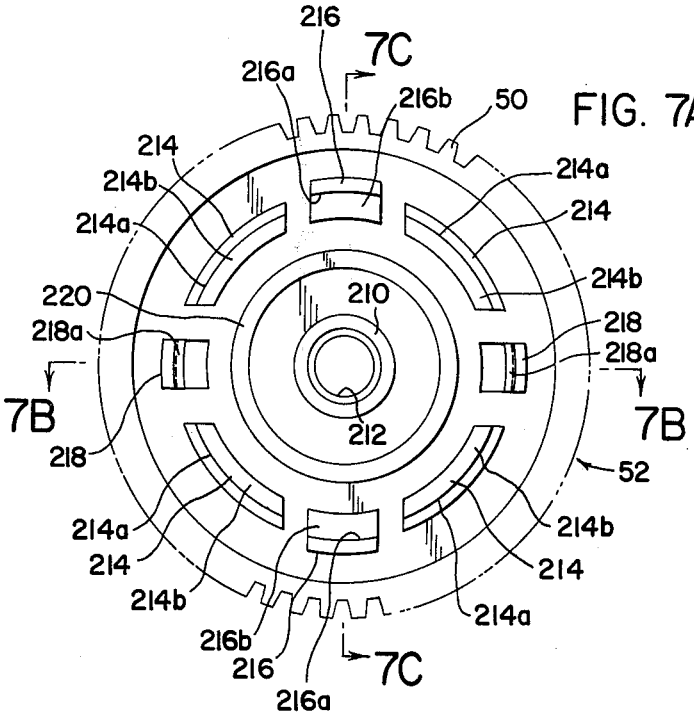
FIG. 7B is a cross-sectional view taken generally along line 7B–7B of FIG. 7A.
FIG. 7C is a cross-sectional view taken generally along line 7C–7C of FIG. 7A.
Figure 8A:
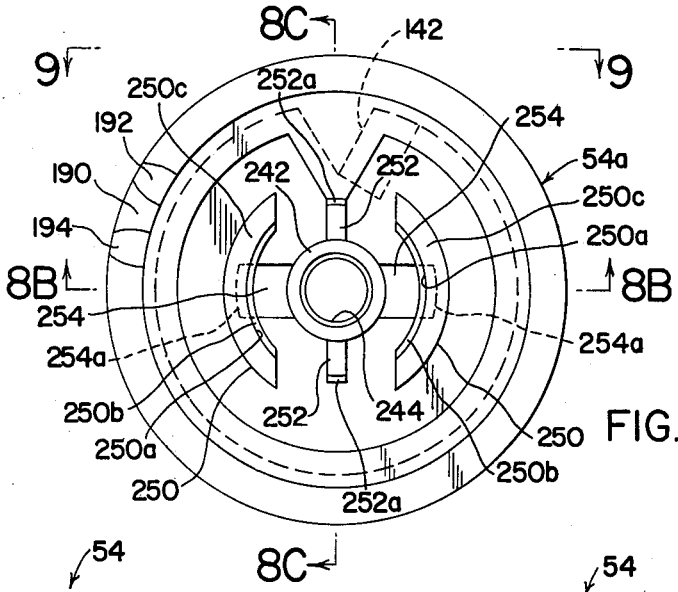
FIG. 8A is an end view taken generally along line 8A–8A of FIG. 8.
Figure 8B:
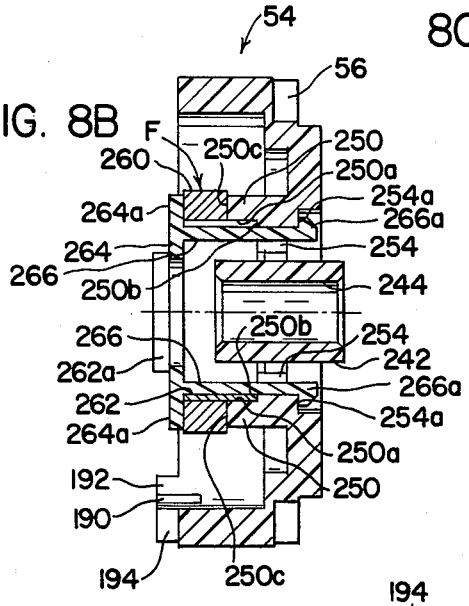
FIG. 8B is a cross-sectional view taken generally along line 8B–8B of FIG. 8A.
Figure 8C:
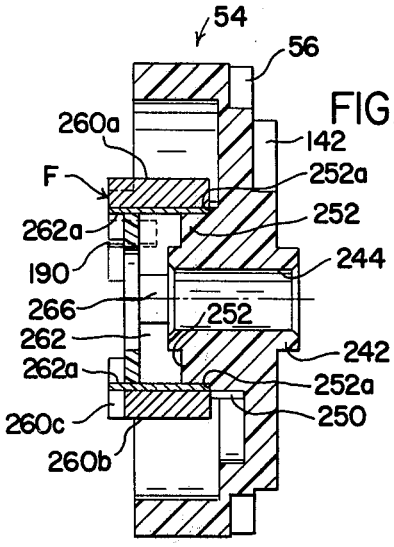
FIG. 8C is a cross-sectional view taken generally along line 8C–8C of FIG. 8A.

Assembly of subwheel 52 is quite apparent from the above description. Referring now to FIG. 7, after the flux concentrator ring 232 has been placed over permanent magnet ring E, this assembly is pushed onto the element52*a*. Surfaces 214*a* engage the inner surfaces of ring 232. Platforms 214*b* engage the smaller portions of magnet ring E to limit inward axial movement of the magnet and flux concentrator ring assembly which is held together by a biasing action between split ring 232 and mmagnet ring E. Surfaces 216*a* engage the outer surface of ring 232. The spacing between lips 214 at ribs 216 is basically the width of enlarged portions 230*a*, 230*b* of magnet E. This aligns the magnet in the proper position in a circumferential direction with respect to element 52*a*. The spacing between adjacent ribs 214 is sufficiently wide to allow inward movement of the enlarged portions on magnet E but to limit circumferential movement thereof so that the known relationship exist between the angular position of element 52*a* and magnet E. Enlarged portions 230*a*, 230*b* rest upon platforms 216*b* and in the assembled position. Thereafter, lock ring 234 is pushed over magnet ring E with the enlarged portions extending through recesses 234a. Lips 218*a* then snap over locking lips 234*d*, as shown in FIG. 7B, to hold ring 234 in its assembled position onto element 52a. In this manner, magnet E is supported concentric with bearing or journal surface 212 and provide the unitary manually adjustable subwheel 52 having a circumferentially extending permanent magnet with the pole arrangement previously described. To provide the proper alignment of magnet ring E, notch 230*c* is located in a selected position. In the preferred embodiment, this position is at the upper portion of element 52*a* as shown in FIG. 7 and facing axially outward therefrom. Referring now to the number subwheel 54, as best shown in FIGS. 8, 8A, 8B, and 8C, a variety of structures could be used for securing an inner cylindrical permanent magnet ring F concentric with shaft 58 and axially aligned magnet ring E, so that the magnet ring carried by the number subwheel 54 would have a balanced magnetic condition which defines the returned position of subwheel 54 with respect to subwheel 52. In accordance with the preferred embodiment of the invention, the mounting arrangement for the second matching magnetic ring F includes element 54*a* of subwheel 54. This element includes an outer cylidrical number surface 240 and an inner hub 242 having a journal surface 244 for journalling element 54*a* onto shaft 58. Element 54*a* includes two diametrically spaced, circumferentiallly extending ribs 250 spaced from each other a distance allowing the insertion of enlarged pole portions of magnet F. Ribs 250 each include an inner surface 250*a* adapted to receive the inner flux concentrator element of magnet F, a lower platform 250*b* for locating the magnet F by its flux concentrator ring and an upper circumferentially extending platform 250*c* for engaging the smaller portion of magnet ring F between its enlarged portions. Radially extending support lugs 252 include lower shoulders 252*a* for engaging the flux concentrator ring of magnet F. The circumferentially extending shoulders 252*a*, in the preferred embodiment, are in the same plane as the circumferentially extending lower platforms 250*b* of ribs 250. These structures limit the inward movement of magnet F in its assembled position, as best shown in FIGS. 8B and 8C. Extending through element 54*a* are a pair of diametrically opposed openings 254 generally in the center of ribs 250 and including rearward lock shoulders 254*a* for use in assembling the magnet ring F onto element 54*a*.

Figure 6A:
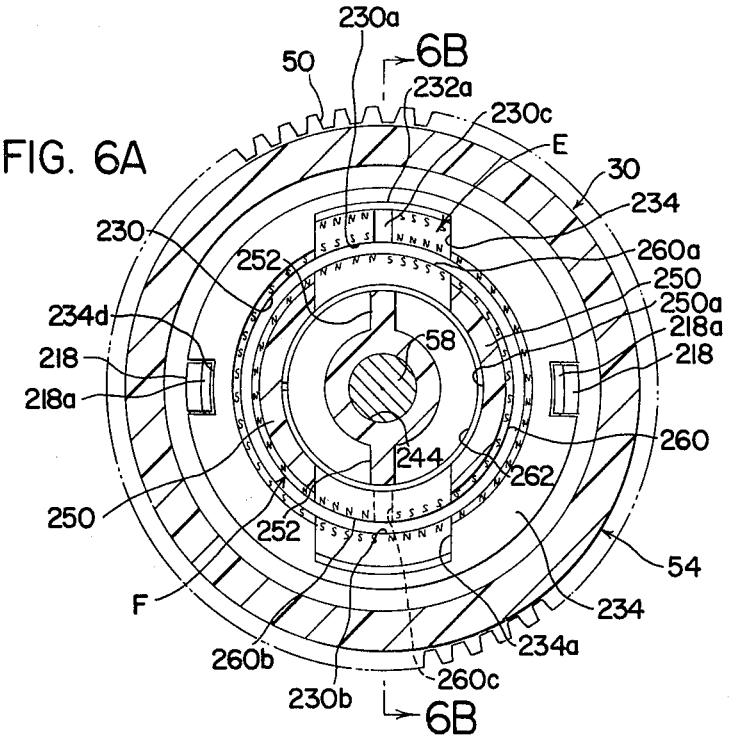
FIG. 6A is a cross-sectional view taken generally along line 6A–6A of FIG. 6.
Figure 6B:
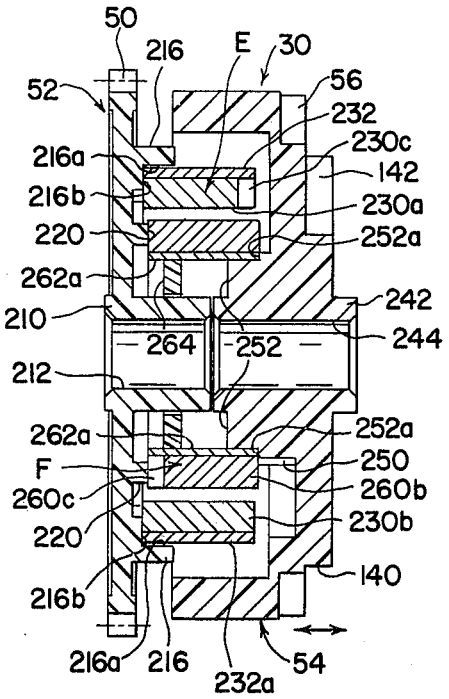
FIG. 6B is a cross-sectional view taken generally along line 6B–6B of FIG. 6A.

Referring now to the center portion of FIG. 8, the permanent magnet ring F is formed in the same manner as permanent magnet ring E and includes a radially outwardly facing, cylindrical pole surface 260 which is adapted to face the pole surface 230 of magnet ring E when subwheels 52, 54 are assembled, as shown in FIGS. 6A and 6B. Magnet ring F includes two enlarged portions 260*a*, 260*b* which in the returned, attracted position of subwheel 54 with respect to subwheel 52 match enlarged portions 230*a* and 230*b*, respectively, of magnet ring E, as best shown in FIGS. 6A and 6B. In accordance with the illustrated embodiment, one of the enlarged pole portions of magnet ring F includes a notch 260*c* for proper orientation during the assembly of magnet ring F onto element 54*a*. The split flux concentrator ring 252 formed from a high permeability material is biased on the inner surface of magnet ring F and includes enlarged portions 262*a* matching the left or outer sections of enlarged portions 260*a*, 260*b*, as clearly shown in FIG. 8. The lower end of the flux concentrator ring 262 is the same plane with an axial end of ring F and provides positive location of the assembly of magnet ring F and ring 262 on shoulders 252*a* and platforms 250*b*.

To assemble magnet F and flux concentrator ring 262 carried thereby onto element 54*a*, there is provided, in the illustrated embodiment, a lock plate 264 having diametrically opposed outwardly extending wings 264*a* which extend between the enlarged portions 260*a*, 260*b* of magnet ring F. Inwardly extending resilient lock fingers 266 on plate 264 include terminal lips 266*a*; which pass through openings 254 and engage the rearward shoulders 254*a* to hold magnet ring F in place. The smaller portions of the pole surfaces rest upon the upper platforms 250*c* and the enlarged portions 260*a*, 260*b* extend between ribs 250, as best shown in FIG. 6A. This orients and secures magnet ring F in its proper position with respect to element 54a.

After the subwheels 52, 54 have been assembled as shown in FIGS. 7B, 7C and 8B, 8C, the two subwheels are positioned on shaft 58, as best shown in FIGS. 6A, 6B. The subwheels are now in the proper position for operation in accordance with the previous discussion f the unit to which the invention is particularly applicable. FIG. 6B, for simplicity, does not include lock ring 234 for holding the magnet E in place; however, it is appreciated that this lock ring is used, as shown in FIGS. 7B and 7C.

Referring now to FIG. 6A, it is illustrated that in the attracted returned position of subwheel 54, the cylindrical pole surfaces of ring magnets E, F, are aligned with opposite polarity magnetic poles facing each other. This provides a strong homing position for the subwheel 54 after it has been released from a timing cycle. By providing the enlarged portions of each pole surface in alignment at the attracted returned position, a substantially increased attraction force is created at this returned or reset position. As subwheel 54 is rotated during the timing cycle, the returning force is at a high magnitude until enlarged pole portions of magnet ring F are spaced from the enlarged pole portions of magnet ring E. At that time, a gradual relatively reduced returning force is created. If the subwheel 54 stops with the enlarged portion of the two pole surfaces out of alignment, there is a returning force created between the poles on the two permanent magnetic rings. As wheel 54 is released, this returning force brings the magnets back toward the position shown in FIG. 6A. At that time, enlarged pole portions commence interaction to produce an enlarged attraction force to return subwheel 54 into a precise, desired returned position as shown in FIG. 6A. Thus, there is a positive action to center the enlarged pole portions with respect to each other. Increased attraction force between the enlarged pole portions adjacent the desired returned position of subwheel 54 reduces the tendency of the rapidly returning number subwheel to move substantially beyond the desired, returned position which over run or over movement can create oscillations and a hunting action. By employing two enlarged pole portions at two positions on each magnet ring, which enlarged portions are aligned at the desired, returned position, a positive and substantial attractive locking force is provided at this position. In other positions, the enlarged portions of one magnet ring face smaller portions of the other magnet ring. This produces a lesser but still substantial returning force causing number subwheel 54 to return toward the desired when released and free to rotate to a position determined by magnet rings E and F. If the number subwheel 54 happens to be in the 180° position after a timing cycle and when released, enlarged pole portion 260*b* faces enlarged pole portion 230*a* and enlarged pole portion 260*a* faces enlarged pole portion 230*b*. Consequently, at the enlarged portions and completely around the two magnets, like poles are facing each other. This produces an inherently unstable repelling situation developing high repelling force between the enlarged pole portions having like poles facing each other. Consequently, in the 180° position, there is no tendency to create a dead spot. The magnets have an increased returning force at this 180° position. Consequently, the most critical situation of a 180° displacement at the end of a timing cycle is positively counteracted to assure that number subwheel 54 will not hang up in the 180° displaced position.

To reduce still further any tendency for subwheel 54 to oscillate at the returned position, as shown in FIGS. 6A and 6B, subwheel 54 is mounted in a manner to provide slight axial movement with respect to shaft 58 and subwheel 52. In the attracted returned position, magnet ring F tends to assume a position axially centered with respect to magnet E. The friction braking ring 220 protrudes inwardly to provide a stop or abutment for magnet ring F before it is actually centered; therefore, in the attratcted, returned position, as shown in FIG. 6B, magnet ring F is still offset axially with respect to magnet ring E and is biased against ring 220 by the magnet attraction forces tending to center the magnet rings axially. This magnetic biasing force tending to center magnet ring F causes engagement between the outer circular friction surface of braking ring 220 and the enlarged portions of magnet ring F. This engagement and biasing creates a friction drag on subwheel 54 in the attracted, returned position to decrease still further in the tendency of the subwheel to oscillate at the returned position. This reduction in oscillation allows more rapid cycling of the timer/counter unit with less time between successive cycles. By providing both the enlarged pole portions at the attracted, returned position and the friction braking action as created by the outer surface of ring 220, oscillation of number subwheel 54 as it returns to the reset position, is substantially reduced. If subwheel 54 is not in the returned position, the friction braking action does not take place since there is an inherent reduction in the attractive force and a creation of a repulsion force between the two magnets which tends to relieve the friction force and shift magnet ring F to the right, as shown in FIG. 6B. Thus, the friction braking force caused by engagement of ring 220 with magnet ring F does not take place to a substantial degree at the non-aligned offset positions of number subwheel 54. The braking action is pronounced at the returned or home position of subwheel 54.

PREFERRED EMBODIMENT FOR CHANGING THE RESET POSITION OF THE SUBWHEELS

Figure 10:
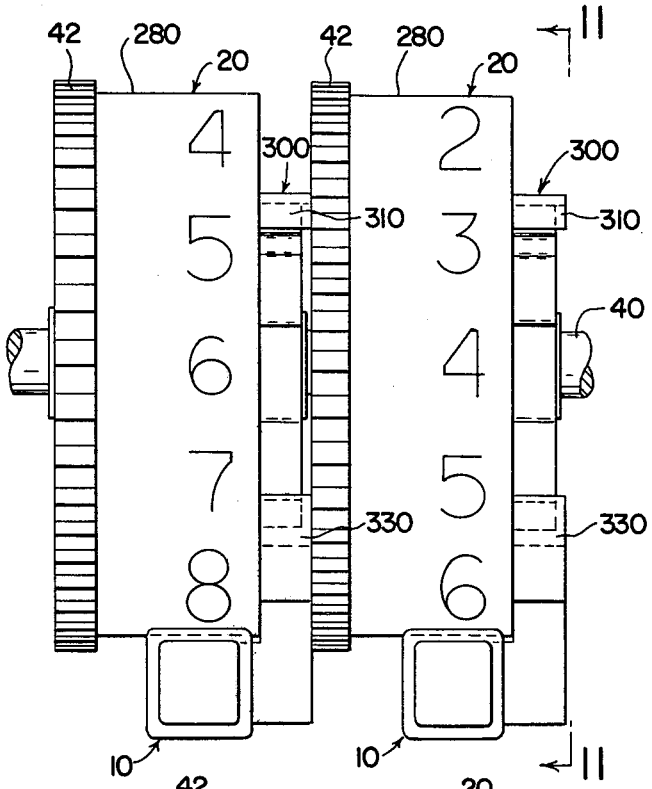
FIG. 10 is a front elevational view showing two adjacent manually adjustable number wheels.

Referring now to the number wheels 20, they are mounted on shaft 40 in axially spaced, side-by-side relationship. Two of these number wheels are illustrated in FIG. 10; however, in the preferred embodiment of the invention four number wheels are employed in the unit A. The description of one number wheel applies equally to the other number wheels. An outer cylindrical number surface 280 carries the digits or numbers displayed in window D of face plate B. Aligning aperture 282 is also provided in this wheel; however, it is not used in the preferred embodiment of the invention. At one side of number wheel 20, opposite to gear 42, is a ratchet wheel 290 having spaced teeth 292, each of which includes an inclined surface 294, a nose 296 and an intermediate recess 298. The push buttons 10 associated with each wheel 20 controls a reciprocal member 300 which carries a rearwardly extending shaft 302. Member 300 is biased in a forward direction by an appropriate spring 304. Push button 10 forces member 300 inwardly to a second or rear position and spring 304 returns member 300 to the rest or first position. Member 300, in accordance with the illustrated embodiment of the invention, includes resilient arm 310 having a rearwardly extending pawl 312. A lower resilient arm 320 innclude a forwarding pointing tip 322. The unitary structure 300 also includes a first angular abutment means 330 and a second angular abutment means 340.

Figure 11:
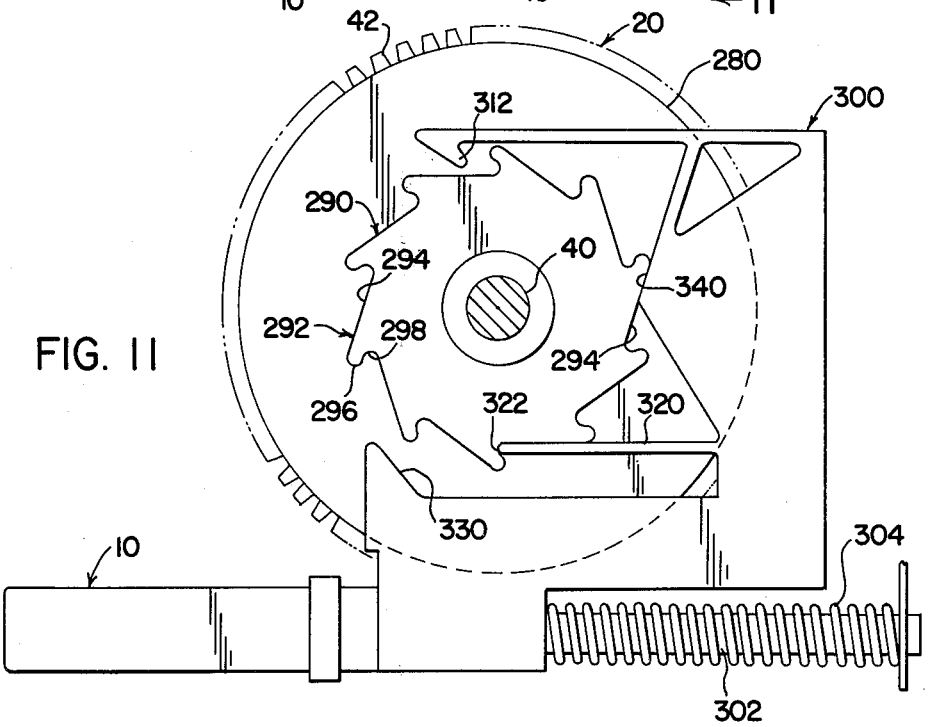
FIG. 11 is a view taken generally along line 11–11 of FIG. 10 and shows the means for indexing the setting of a number wheel.
Figure 12:
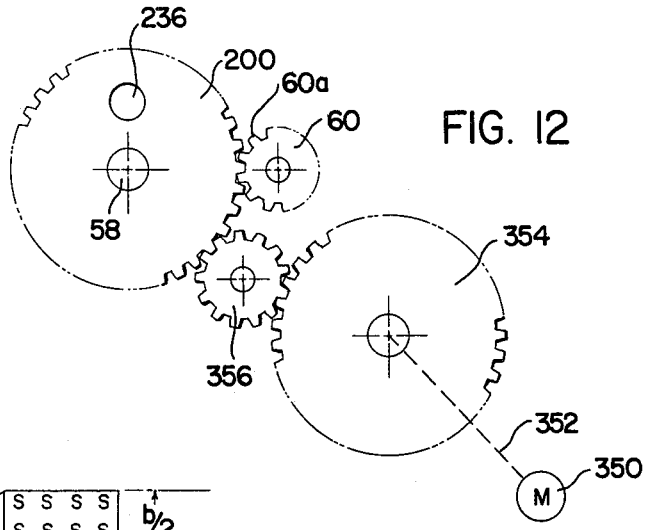
FIG. 12 is a schematic view illustrating the drive arrangement employed for timing in accordance with the preferred embodiment of the present invention.

FIG. 11 illustrates member 300 in the at rest or first position. Second abutment means 340 is biased against surface 294 of one of the teeth 292 to limit the forward movement of member 300 and locks the wheel in a selected digit position. To change the digit by one, push button 10 is depressed. When push button 10 is depressed against spring 304, pawl 312 engages a recess 298 of one tooth 292 and draws ratchet wheel 290 in a clockwise direction. This movement is limited by the first abutment means 330 which engages an inclined surface 294 of another tooth on the ratchet wheel. This action limits the rearward movement of member 300 and provides partial rotation of the number wheel 20. Thereafter, the push button is released and tip 322, which is aligned with a recess 298, engages the recess and drives the ratchet wheel further in the clockwise direction. At this time, the second abutment means 340 again engages the ratchet wheel to prevent further movement of wheel 20. This indexing procedure is continued until the desired digit is shown in window D. Thereafter, the other number wheels are changed accordingly one digit at a time until the desired cycle is set. Since the number wheels are meshed with the first subwheel 52 of wheel assemblies 30, the cycle can be changed by the push button during the counting or timing cycle of unit A. The numbers recorded in window D always illustrate the condition to which the upper resettable wheel assemblies 30 will return during a reset cycle by actuation of solenoid 150. The second abutment means 340 holds both the number wheel and the first subwheel 52 of the upper wheel assembly.

MAGNETIC CHARACTERISTICS OF THE INVENTION

Figure 13:
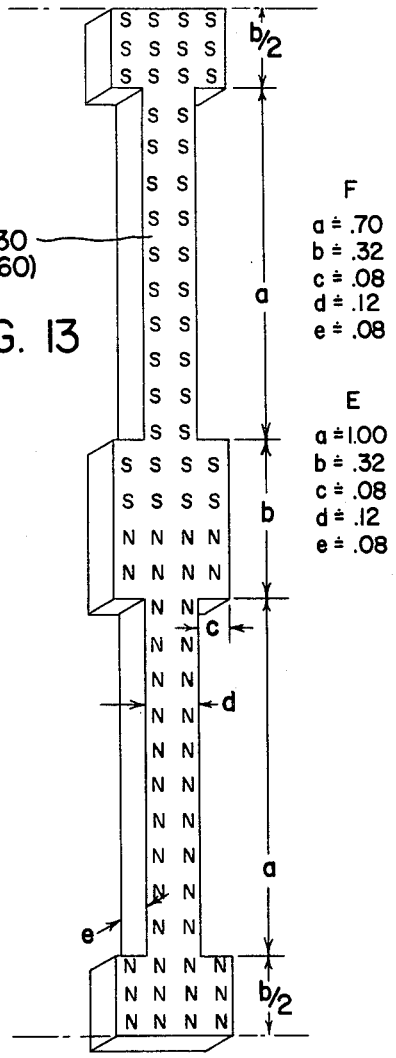
FIG. 13 is an uncoiled schematic view of one magnetic ring used in accordance with the preferred embodiment of the present invention with certain representative dimensions.

Referring now to FIGS. 13–22, certain magnetic characteristics of the invention are schematically illustrated. These principles have been discussed in connection with the preferred embodiment of the invention; however, discussion thereof with respect to simplified drawings may be helpful. The shape of the magnetic ring is schematically illustrated, in FIG. 13, as being cut at an enlarged pole section and unwound into a flat configuration. the outwardly facing surface is the pole surface of the magnet rings and shows the general shape of the surfaces 230, 260. Of course, this is a simplified drawing and the actual shape of an unwound magnet ring would be somewhat different. FIG. 13 also includes dimension *a*, *b*, *c*, *d*, and *f*, and indicates the approximate magnitude of these dimensions in the preferred embodiment of the present invention. As can be seen, the two magnetic rings E and F have substantially the same dimensions except for the length of the smaller pole portions between the enlarged pole portions. The smaller pole portions of magnet ring E are longer to allow for the larger diameter of magnet ring E which encircles smaller magnet ring F. The dimensions are included to provide some indication of the magnitude and size of the magnets used in accordance with the invention. The poles along the pole surfaces could be closely spaced like polarity poles in each semi-circular half of the magnetic rings. Since the magnet rings are magnetized after being injection molded, in accordance with normal practice, the magnetization is in a radial direction which means that the opposite polarity poles will appear on the surface of the magnetic rings opposite to the pole surfaces 230, 260 being used to provide the operative poles in the present invention. The two enlarged pole portions in each magnet ring, which are diametrically opposite to each other in each magnet ring, could be provided by magnetizing a cylindrical magnetic ring with a pattern used in the preferred embodiment while the actual shape of the magnet ring or rings could have a uniform axial width. The flux concentrator rings are resiliently biased and held by friction on the cylindrical surfaces of the magnet rings opposite to the pole surfaces to reduce the reluctance at these opposite or rear surfaces. Of course, various changes in the dimensional proportion of the magnet rings could be used to obtain different force characteristics without departing from the intended spirit and scope of the present invention.

Figure 14:
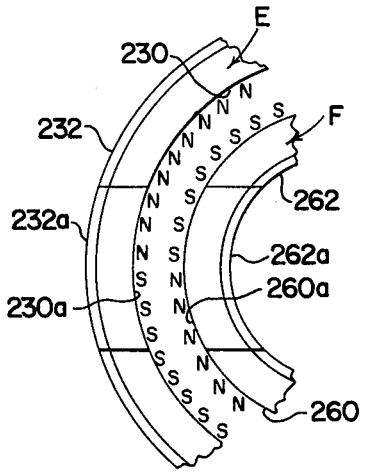
FIG. 14 is a partial view showing the two magnetic rings in their return position.
Figure 15:
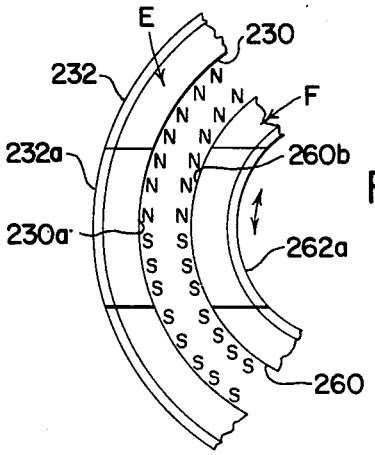
FIG. 15 is a view similar to FIG. 14 showing the magnetic rings in a position 180° shifted from the position shown in FIG. 14.

Referring now to FIG. 14, the returned, attracted position of magnet ring F with respect to magnet ring E is illustrated. As can be seen, this condition is a magnetically balanced condition wherein an attraction force is created between the facing poles of the magnet rings. This attraction position is stable and positive. Slight variations in the angular position of ring magnet F will cause a magnetically unbalanced condition which would be automatically corrected when ring magnet F is released for rotation about shaft 58. In FIG. 15, the magnet F has been rotated 180° so that like poles face each other. This is an unstable repulsion situation which creates a high magnetic return force. The force is increased due to the enlarged portions of each magnet ring facing each other. According to the deviation from exact alignment in the position shown in FIG. 15, the magnet ring F will return to the position shown in FIG. 14 in one of the directions indicated by the arrow in FIG. 15.

Figure 16:
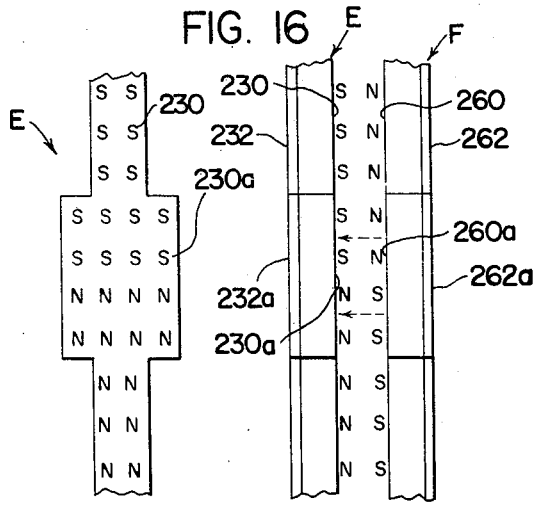
FIG. 16 is a schematic view illustrating certain operating characteristics of the present invention.
Figure 16A:
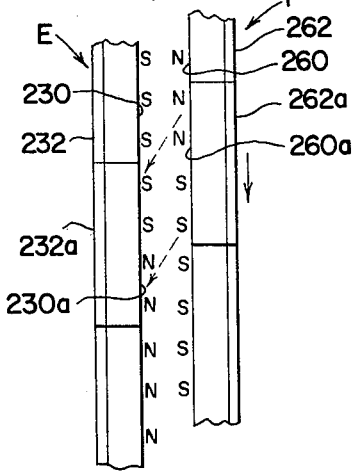
FIGS. 16A–D are views somewhat similar to FIG. 16 illustrating the operating characteristics of the preferred embodiment of the invention.
Figure 16B:
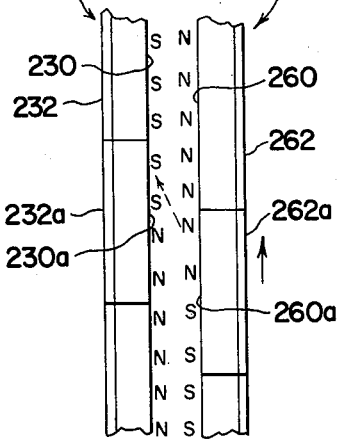
Figure 16C:
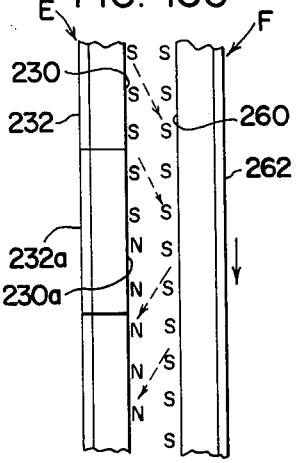
Figure 16D:
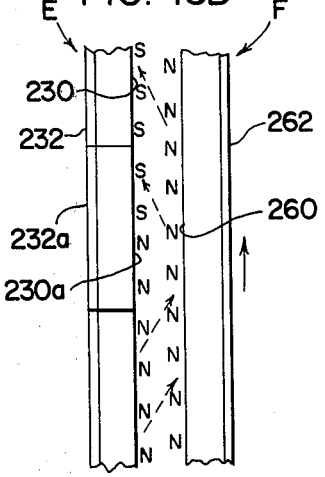
Figure 16D:
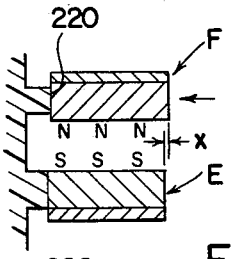

Referring now to FIG. 16, a portion of magnet ring E is indicated to be a flat surface to show operating characteristics of the invention. In the returned position, shown in FIG. 16, the two magnets E and F attract each other and are balanced. As shown in FIG. 16A, as soon as magnet F is shifted upwardly, there is a large magnetic attraction force between the two enlarged pole areas or portions which force attempts to balance each other and seek the position shown in FIG. 16 if magnet F is released and free to rotate. The north pole of the enlarged portion 260*a* of magnet F are attracted to the south poles of the enlarged portion 230*a*. At the same time, the south poles of enlarged portion 230*a* attempt to repel the overlapping south poles of enlarged portion 260. These two forces are additive and are reduced to a stable condition only when the enlarged portions are aligned as shown in FIG. 16. If the magnet F is shifted downwardly, as shown in FIG. 16B, the north poles of the enlarged portion 230*a* attract the south poles of the enlarged portion 260*a*. At the same time, the overlapping north poles of the two enlarged portions tend to repel each other. This produces a balancing force in the reverse direction and becomes magnetically stabilized only in the position shown in FIG. 16. If magnet F is shifted to a position without the alignment of the enlarged portions either in a stable attraction position or an unstable 180° repulsion position, the condition shown in FIGS. 16C, 16D occur. In this condition, like poles repel and the unlike poles attract to drive the magnet F in the direction indicated by the arrows. This driving force continues at a substantially constant torque until the enlarged portions approach each other. At that time, greater magnetic forces occur to positively move the magnet ring F in its returned position.

Figure 17:
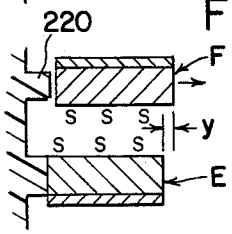
FIG. 17 is a schematic representation of the braking concept employed in the preferred embodiment of the present invention; and, FIG. 19 is a graph illustrating the torque created by the magnetic system employed in accordance with the preferred embodiment of the present invention.
Figure 18:
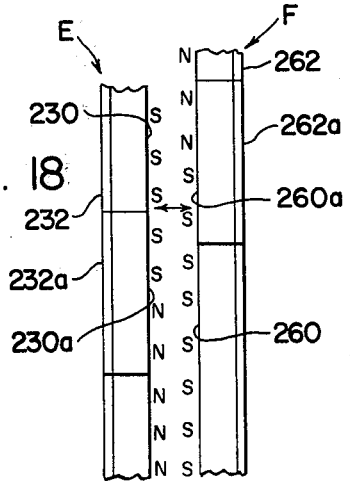

Referring now to FIGS. 17 and 18, the friction braking concept of the invention is illustrated. In the upper view of FIG. 17, the magnets E and F are shown schematically in the attracted position. There is a small dimension *x* which represents a slight axial inbalance of the two magnets even in the home position. This has no effect upon the circumferential balancing required in the reset operation. However, it does hold the magnets from the axial balanced position and allow the use of the friction surface on braking ring 220. When inner magnet F is rotated from the attracted home position, certain like poles will face each other as shown in the lower portion of FIG. 17. When this happens, there is a reduction in the force tending to center the two magnets into axial alignment. Indeed, at 180° out of phase, there is a strong force tending to shift the two magnets axially with respect to each other and away from ring 220. Since even in the home position there is a slight misalignment represented by dimension *x*, when the magnet F is repelled the magnet will move in the direction shown in the lower view of FIG. 17 and away from ring 220. By providing a slight amount of misalignment as shown in the upper view of FIG. 17, repulsion force on magnet F will always be away from the friction ring and the attraction force will be toward ring 220. In addition, by providing the distance *x* in the home position, there is always a friction force created in the home position because the magnets do not reach the balanced axial condition. The provision of a slight axial misalignment in the home position of subwheel 54 determined by the ring 220 extending axially from element 52*a* provides a damping friction force in the home position and a repulsion axial force in the 180° position. Between these two positions, there is a release of the frictional force after a slight relative rotation by magnet ring F. In the preferred embodiment of the invention, dimension $x$ is in the general range of 0.005 inches to 0.011inches. This provides a positive braking force at the home position and a rapid release of this friction force when magnet F is not in the home position. As shown in FIG. 18, as soon as there is a slight shift from the home position, there is a repelling force created by the alignment of like polarity magnetic poles on the enlarged portions of the magnets E and F. This relieves the force between ring 220 and magnet F. Thus, after a slight rotation beyond the home position the force between ring 220 and magnet F is released quite rapidly. The allowable axial movement $y$ can be adjusted to be only slightly larger than the distance $x$ so that as soon as a repelling force is created by movement of ring magnet F, the maximum shifting away from ring 220 takes place. This adjustment can be accomplished by the spacing of the snap rings between adjacent wheel assemblies 30.

Figure 19:
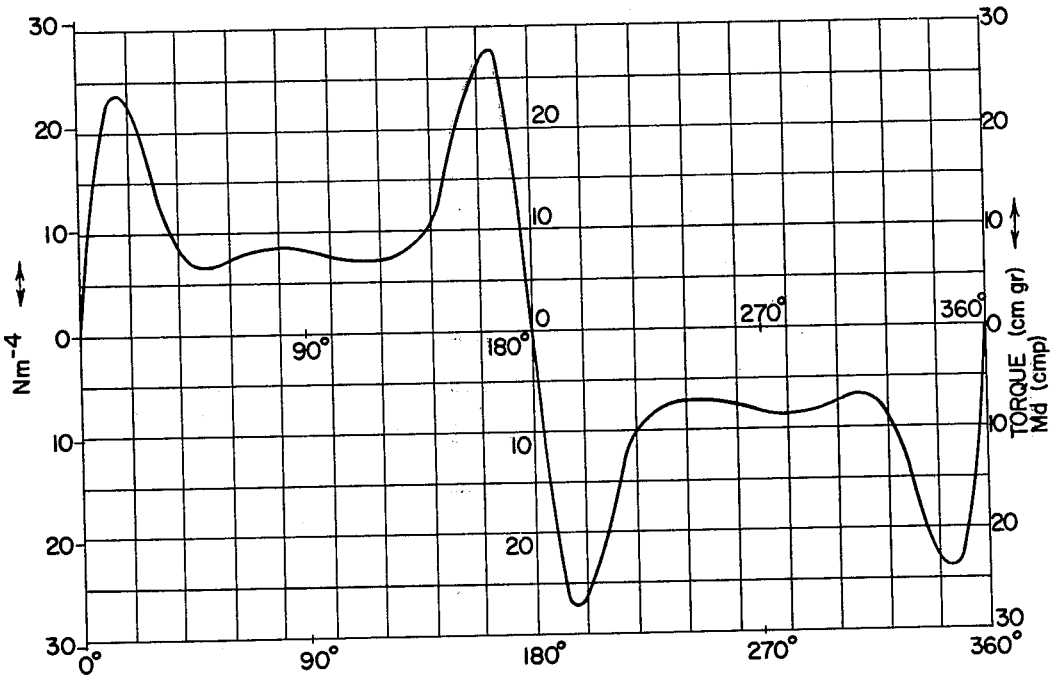

In FIG. 19 there is illustrated a chart of the returning torque created at different angular positions of subwheels 54 in the preferred embodiment of the present invention. As can be seen, as soon as there is slight angular movement of subwheel 54 with respect to subwheel 52, a rapid increase in restoring torque occurs. This is due to the use of the enlarged pole areas at the home position. After the number subwheel has been rotated to a position where there is no appreciable interaction of the enlarged pole portions, a reduced torque occurs which is relatively constant until the 180° position is approached. Adjacent the 180° position a high returning torque is created. As is well known, a balanced condition can not occur in a repulsion magnetic system of the type to which the present invention is directed and a high returning torque is created at the 180° position. As rotation of subwheel 54 increases beyond the 180° position, the returning torque is in an opposite direction. After the enlarged pole portions are no longer aligned, the returning torque is substantially the same as the constant torque provided between the home position and the 180° position, but in the opposite direction. As the subwheel 54 approaches the home position, the enlarged pole portions again coact to produce an attraction force of high order for bringing the subwheel 54 into its home position when released for return. By viewing FIG. 19, the returning torque at any position of subwheel 54 is quite apparent. When the subwheel is released at any position shown on the chart, there is a substantial returning torque in one direction which torque increases drastically at the home position. This provides a positive homing action and reduces tendency to oscillate or hunt in the returned position. Modifications could be made in this graph by changing the circumferential length of the enlarged portions. FIG. 19 clearly shows the advantage of the invention to which the present application is directed.

The facing pole surfaces have two poles each of which extend approximately 180° and an enlarged pole area or portion is provided at the pole junctions of each surface. The enlarged portions are substantially the same size and match each other in the home position and the 180° position.

Having thus described my invention, I claim:

1. In a device for returning a first member rotatable about a given axis to a selected angular position with respect to a second member which device includes means for rotating said first member from said selected angular position, means for releasing said first member for rotation about said given axis and means for changing said selected position, the improvement comprising: a first ring formed from a permanently magnetizable material, said first ring having a generally circular first pole surface with a set of opposite polarity magnetic poles arranged in a selected pole pattern on said first pole surface; means for securing said first ring onto one of said first and second members with said first surface generally concentric to the given axis; a second ring formed from a permanently magnetizable material, said second ring having a generally circular second pole surface generally facing said first pole surface and having opposite polarity magnetic poles arranged in a pole pattern matching said selected pattern with poles of said first surface generally facing opposite polarity poles of said second surface when said first member is in said selected angular position; means for securing said second ring onto the other of said first and second members with said second surface generally concentric to said given axis and each of said poles on each of said surfaces extending circumferentially approximately 180°.

2. The improvement as defined in claim 1 wherein said pole surfaces face radially of said given axis.

3. In a device for returning a first member rotatable about a given axis to a selected angular position with respect to a second member which device includes means for rotating said first member from said selected angular position, means for releasing said first member for rotation about said given axis and means for changing said selected position, the improvement comprising: a first ring formed from a permanently magnetizable material, said first ring having a generally circular first pole surface with a set of opposite polarity magnetic poles arranged in a selected pole pattern on said first pole surface; means for securing said first ring onto one of said first and second members with said first surface generally concentric to the given axis; a second ring formed from a permanently magnetizable material, said second ring having a generally circular second pole surface generally facing said first pole surface and having opposite polarity magnetic poles arranged in a pole pattern matching said selected pattern with poles of said first surface generally facing opposite polarity poles of said second surface when said first member is in said selected angular position; means for securing said second ring onto the other of said first and second members with said second surface generally concentric to said given axis, each of said pole surfaces including a portion wherein one magnetic pole is adjacent to a second magnetic pole of opposite polarity and wherein said portion has a pole width greater than the width of said poles of said surface spaced from said position.

4. The improvement as defined in claim 3 wherein each of said poles on each of said surfaces extend circumferentially approximately 180°.

5. The improvement as defined in claim 3 wherein said pole surfaces face radially of said given axis.

6. In a device for rotating a first member about a given axis to a selected angular positin with respect to a second member, the improvement comprising: a first magnet secured to said first member and having a first magnetic pole surface facing radially of said axis; a second magnet secured to said second member and having a second pole surface facing radially of said axis and facing said first pole surface; said pole surfaces having opposite polarity magnetic poles with poles of said first surface opposite to poles of said second surface when said first member is in said selected position; means for mounting said magnets for relative axial magnetic attraction induced movement in a first direction when said first member is in said selected position; friction braking means engageable upon said relative movement in said first direction for damping oscillations of said first member with respect to said second member.

* * * * *